US012359819B1

(12) United States Patent
Mercer et al.

(10) Patent No.: US 12,359,819 B1
(45) Date of Patent: Jul. 15, 2025

(54) SYSTEMS AND METHODS FOR JOINING METAL AND CERAMIC COMPONENTS OF A KAMADO-STYLE GRILL

(71) Applicant: Premier Specialty Brands LLC, Chamblee, GA (US)

(72) Inventors: Daniel Mercer, Hamilton, GA (US); Mark Huddleston, Columbus, GA (US)

(73) Assignee: Premier Specialty Brands, LLC, Chamblee, GA (US)

( * ) Notice: Subject to any disclaimer, the term of this patent is extended or adjusted under 35 U.S.C. 154(b) by 0 days.

(21) Appl. No.: 18/954,876

(22) Filed: Nov. 21, 2024

(51) Int. Cl.
*A47J 37/07* (2006.01)
*F24B 13/02* (2006.01)

(52) U.S. Cl.
CPC ..... *F24B 13/02* (2013.01)

(58) Field of Classification Search
CPC ..... F24B 13/02
USPC ..... 126/25 R, 151
See application file for complete search history.

(56) References Cited

U.S. PATENT DOCUMENTS 1,933,743 A * 11/1933 Lockhart ..... F24H 3/008 126/151
2,302,929 A * 11/1942 Allen ..... F24B 13/02 126/77
3,276,440 A * 10/1966 Sazegar ..... A47J 37/0704 126/25 A
3,809,058 A * 5/1974 Becker ..... F24B 1/181 D23/343
5,737,379 A * 4/1998 Erbes ..... G21C 13/02 376/302
9,603,484 B2 * 3/2017 Cleveland ..... A47J 37/049
10,092,135 B2 10/2018 DeBruler
10,231,575 B1 3/2019 Nicoll et al.
10,470,610 B2 * 11/2019 Rummel ..... A47J 37/0786
10,495,315 B2 * 12/2019 DeMars ..... F24B 3/00
11,445,847 B2 * 9/2022 Bogazzi ..... F24B 1/207
2006/0048764 A1 * 3/2006 Mashburn ..... A47J 37/0704 126/39 B
2020/0281404 A1 9/2020 Benson et al.
2023/0337856 A1 10/2023 Carter et al.
2023/0397764 A1 12/2023 Sewall et al.

OTHER PUBLICATIONS

Written Opinion of International Searching Authority, PCT Application No. PCT/US2024/056833, dated Feb. 6, 2025.
International Search Report of International Searching Authority, PCT Application No. PCT/US2024/056833, dated Feb. 6, 2025.

* cited by examiner

*Primary Examiner* — Avinash A Savani
(74) *Attorney, Agent, or Firm* — Miller & Martin PLLC

(57) ABSTRACT

Embodiments of the presently disclosed invention comprise systems and methods for joining and securing components formed of different materials in a kamado-style grill. For instance, in an exemplary embodiment of the disclosure, ceramic and metallic portions of a base of a kamado-style grill are joined using a tension element that is positioned between the ceramic and metal portions. In some embodiments, the tension element may be expanded or retracted to create a friction fit between the ceramic and metal portions. The tension element may be positioned below an upper lip or a substantially horizontal ledge that prevents a user from physically separating the ceramic and metal portions of the base of the kamado-style grill.

18 Claims, 10 Drawing Sheets

SYSTEMS AND METHODS FOR JOINING METAL AND CERAMIC COMPONENTS OF A KAMADO-STYLE GRILL

TECHNICAL FIELD

Embodiments of the presently disclosed invention generally relate to the field of kamado-style grills and smokers, and more particularly relate to systems and methods for joining different materials together to form the body of a kamado-style grill and smoker.

BACKGROUND OF THE DISCLOSED EMBODIMENTS

"Kamado" is the Japanese term for a traditional cooking stove fueled by wood or charcoal. In its more modern sense, the term kamado has come to denote a wood-fired and/or charcoal-fired cooking vessel typically made from ceramic, clay, terracotta, cement, or crushed lava rock to create a grill that can withstand temperatures in excess of 750 degrees Fahrenheit without cracking from extreme heat or temperature fluctuations. Modern kamados, referred to herein as "kamado-style" grills, may be formed from any suitable metals and/or refractory materials, including but not limited to the materials above alone or in combination with other materials, such as metals and metal alloys. For example, the refractory materials in kamado-style grills may include advanced or engineered ceramics, such as composite and/or reinforced ceramics. The refractory materials may be used to form an enclosed cooking chamber that is resistant to decomposition by heat and that retains its shape when the kamado-style grill is in use.

Because kamado-style grills and smokers are highly efficient at retaining heat, they can be used to maintain consistent cooking temperatures over a large temperature range, such as between 225 and 750 degrees Fahrenheit. As a result, a kamado-style grill provides a versatile cooking apparatus that can be used for grilling, smoking, stewing, roasting, and baking many different kinds of foods. Further, because a kamado-style grill may be used as a grill or a smoker, it may be interchangeably referred to herein as a "kamado-style grill," "kamado-style smoker," "kamado-style grill and smoker," "kamado-style cooker," etc.

A kamado-style grill may comprise a generally egg-shaped body ("base") with a domed top cover. Kamado-style grills usually have a hinged top because the domed top cover can be very heavy and difficult to handle if it were not attached to the body of the grill. The cooking chamber of the kamado-style grill, i.e., the enclosed portion containing the heating fuel and the cooking surface, is typically ovoid in shape with circular or oval horizontal cross-sections, though square, rectangular, and other horizontal cross-sectional areas are also possible. The cooking chamber of a kamado-style grill is usually heated by a combustible fuel, such as charcoal or wood, placed at or near the bottom of the chamber within the grill base.

While the body of kamado-style grills is typically composed of a ceramic material, it may be desirable to form the body of a kamado-style grill of two or more materials. For instance, one might wish to use a metal material to house certain accessory components, such as electronics for monitoring and/or controlling the temperature within the grill, grips or handles for lifting the grill, or controls for a user to manually adjust the grill temperature. Due to the brittle nature of the ceramic material in the grill's base and the desire for it to have good heat-retention properties, some types of heat-sensitive or pressure-sensitive accessories may not be capable of being embodied directly in the ceramic material and would be better suited for inclusion on a metal portion of the grill's base. Therefore, having separate ceramic and metal portions on the base of the kamado-style grill may be advantageous.

Combining metal with a ceramic material in the base of a kamado-style grill is not without its challenges. Previous solutions involved forming holes in each of the ceramic and metal portions of the base and joining the ceramic and metal portions using one or more bolts inserted through their aligned holes and secured with lock nuts; however, over time, the ceramic material may crack around the holes through which the bolts are inserted, thereby diminishing the structural integrity of the ceramic portion of the base and the desired heat-retention properties of the grill.

Therefore, there is need for a mechanism for joining and securing metal to ceramic portions of a grill's base in a manner that reduces the risk of cracking while preserving the desired heat-retention properties of the grill. The various embodiments of the presently disclosed invention address these and other considerations.

SUMMARY OF THE DISCLOSED EMBODIMENTS

The disclosed embodiments of the invention comprise systems and methods for joining ceramic and metal components of a kamado-style grill. In the disclosed embodiments, the systems and methods may be employed in the base of a kamado-style grill, where the base may comprise two or more portions formed of different materials in order to realize certain benefits. For instance, the base may comprise a top ceramic portion and a bottom metal portion, where the bottom metal portion may house one or more accessories. The accessories may comprise, for example, one or more of a fan unit, a digital controller, user controls, a display, an automatic ignitor, or a grip or handle. In some embodiments, the metal portion may comprise a metal alloy, and in some embodiments, the ceramic portion may comprise an engineered ceramic material, such as a reinforced ceramic and/or ceramic composite.

In some embodiments, the ceramic portion may be a generally ring-shaped and hollow piece of the base. For example, in some embodiments, the ceramic portion may comprise an upper body configured to mate with a ceramic lid of the kamado-style grill when the lid of the grill is closed and may further comprise a lower body configured to mate with a metal portion of the base. In some embodiments, the lower body may comprise a region that is recessed from the upper body such that the recessed region of the lower body has a smaller outer diameter than an outer diameter of the upper body. In some embodiments, the recessed region of the lower body also may have a smaller outer diameter than an inner diameter of the metal portion, such that the recessed region of the lower body can fit within the metal portion.

In some embodiments, the metal portion may form a bottom of the base. The metal portion may comprise a lower body facilitating use of various accessories, and an upper junction area that is configured to receive the recessed region of the ceramic portion when it is inserted within the metal portion. For instance, the upper junction area of the metal portion may have a larger inner diameter than the outer diameter of the recessed region of the ceramic portion. The metal portion may further comprise an upper lip or a substantially horizontal ledge that extends inwardly from a top edge of the metal portion in the upper junction area. In some embodiments, a bottom surface of a non-recessed portion of the lower body of the ceramic portion may be seated on or otherwise supported by at least a portion of a top surface of the upper lip or substantially horizontal ledge on the upper junction area of the metal portion.

In accordance with the disclosed embodiments, the ceramic portion and metal portion can be joined and secured using a tension element (e.g., a "tension band"). In some embodiments, the tension element comprises a ring-shaped band composed of a rounded, flexible strip of material (e.g., a metal) having two unconnected ends. The two unconnected ends may be bent into a pair of tabs which extend outwardly and away from the remainder of the ring-shaped band. The pair of tabs each may comprise a respective hole configured to receive a fastener to tighten or loosen the tension element. The fastener may be any fastening element now known or later discovered capable of tightening or loosening the tension element, including without limitation a nut-and-bolt fastener.

When the ceramic portion and the metal portion are assembled, in some embodiments the tension element first may be positioned circumferentially within the upper junction area of the metal portion. Then the recessed region of the ceramic portion may be placed within the upper junction area adjacent to the tension element. The tension element may be tightened around the recessed region of the ceramic portion, for example, using the fastener of the tension element located outside of the base. Because the tension element, after it has been tightened around the recessed region of the ceramic portion, is positioned underneath the upper lip or substantially horizontal ledge of the upper junction area of the metal portion, the tension element prevents a user from pulling the ceramic portion upward to separate it from the metal portion of the base. That is, the tension element may be physically blocked by the upper lip or substantially horizontal ledge to prevent the user from pulling the ceramic portion with the tension element out of the upper junction area of the metal portion of the base.

In other disclosed embodiments, the tension element may be first positioned around at least a portion of the recessed region of the ceramic portion and then placed inside the metal portion of the base, for example, within the upper junction area and below the upper lip or ledge. In such embodiments, the tension element may be tightened around the recessed region of the ceramic portion before both recessed region and the attached tension element are placed inside the upper junction area of the metal portion. Thereafter, the fastener on the tension element can then be adjusted from outside of the base to expand (e.g., loosen) the tension element and create a friction fit between an interior surface of the upper junction area of the metal portion, the tension element, and an exterior surface of the recessed region of the ceramic portion. In such embodiments, the friction fit created using the tension element, and its positioning below the upper lip or substantially horizontal ledge of the metal portion, may be used to securely join the ceramic portion of the base to the metal portion of the base without having to form holes in the ceramic and metal portions as conventionally done. Because the tension element is again positioned below the upper lip or substantially horizontal ledge in such embodiments, the tension element may be physically blocked by the upper lip or ledge to further prevent a user from pulling the ceramic portion upward to separate it from the metal portion of the base.

Advantageously, use of the tension element as described in the disclosed embodiments instead of using bolts to join the ceramic and metal portions of a base of a grill avoids the conventional problems of forming cracks (and related heat loss) around the bolts' holes typically caused by repeated thermal cycling in the grill. The present disclosure is merely exemplary of certain exemplary embodiments of the present invention. Further objects, features, and advantages will become apparent upon consideration of the following detailed description of the exemplary embodiments when taken in conjunction with the drawings and the appended claims.

BRIEF DESCRIPTION OF THE DRAWINGS

The particular features and advantages of the invention will become apparent from the following description taken in connection with the accompanying drawings in which like reference numbers indicate identical or functionally similar elements. The following figures depict details of disclosed embodiments. The invention is not limited to the precise arrangement shown in these figures, as the accompanying drawings are provided merely as examples.

DETAILED DESCRIPTION OF THE DISCLOSED EMBODIMENTS

Figure 1:
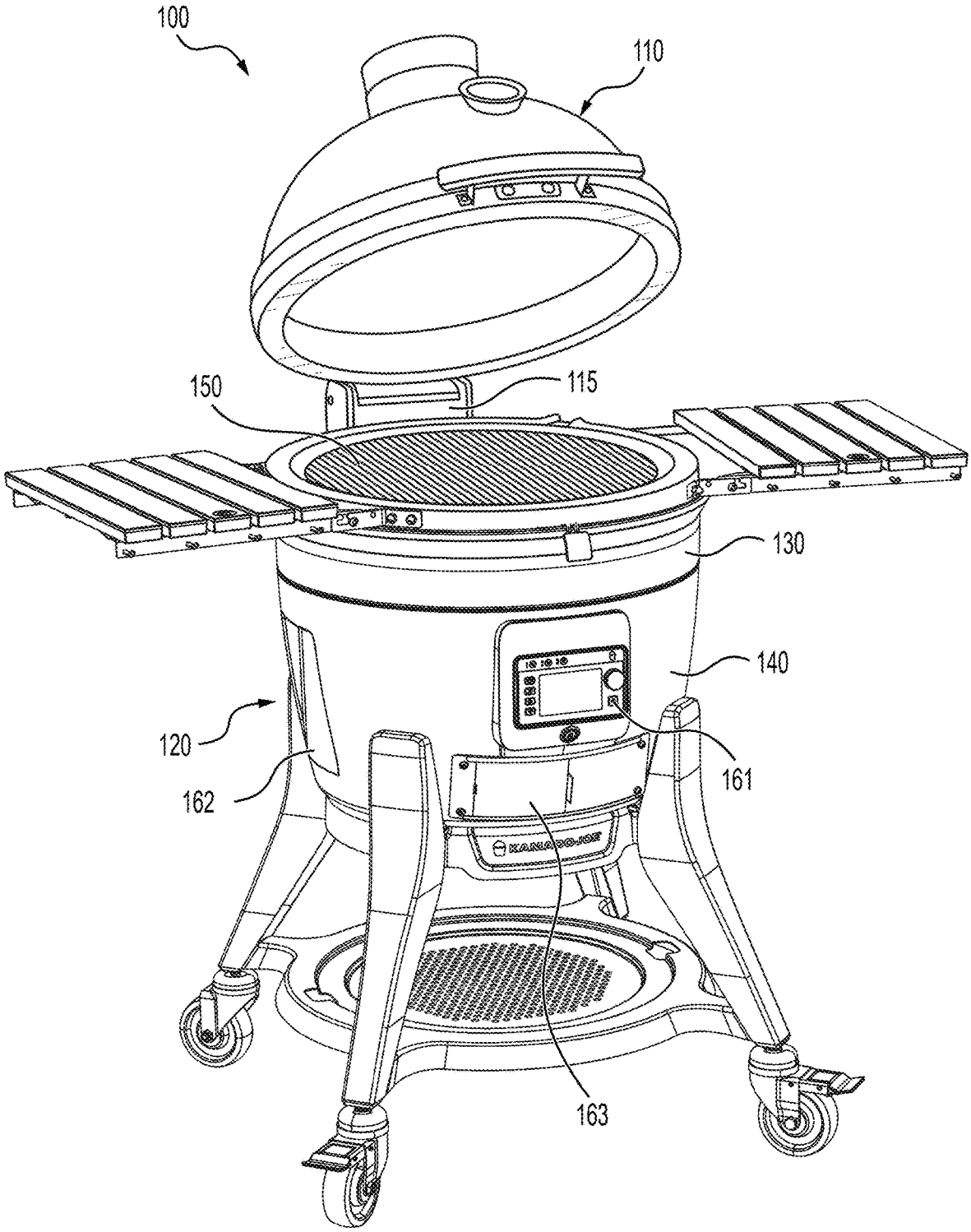
FIG. 1 is a perspective view of an exemplary kamado-style grill that may be used in accordance with certain embodiments of the present invention.

FIG. 1 illustrates an exemplary kamado-style grill 100. In some exemplary embodiments, the kamado-style grill 100 may be generally constructed as shown and described in U.S. Pat. Nos. 11,382,457 and 11,819,161, and U.S. patent application Ser. No. 18/216,674, each titled "Integrated Kamado-style Grill and Smoker," and each of which is hereby incorporated by reference in its entirety as if fully set forth herein. In the embodiment of FIG. 1, the kamado-style grill 100 comprises a top shell 110 (or lid) and a bottom shell 120 (or base) connected by a hinge 115. The bottom shell 120 can comprise a ceramic portion 130 and a metal portion 140. In some embodiments, ceramic portion 130 can be positioned above metal portion 140. Ceramic portion 130 may be sized and shaped to enclose or circumscribe a cooking area 150. Metal portion 140 may comprise various accessories, such as the example accessories 160*a*-160*c*, which may include for example a control unit 160*a*, handles or grips 160*b*, and a slidable door 160*c*. It is understood that metal portion 140 may comprise various other accessories not shown in FIG. 1, including a fan unit and may house various internal components, such as a firebox and ignitor. While the various embodiments of the present invention are discussed in terms of the exemplary kamado-style grill 100, it is understood that the present invention may be implemented in various other types of grills and smokers, or even other cooking and non-cooking apparatuses, now known or later discovered, in which a first portion of the apparatus composed of a first material (such as a ceramic or other refractory) is connected to a second portion of the apparatus composed of a second material (such as a metal, and for instance, cold-rolled steel, or another alloy such as stainless steel or aluminum).

Figure 2:
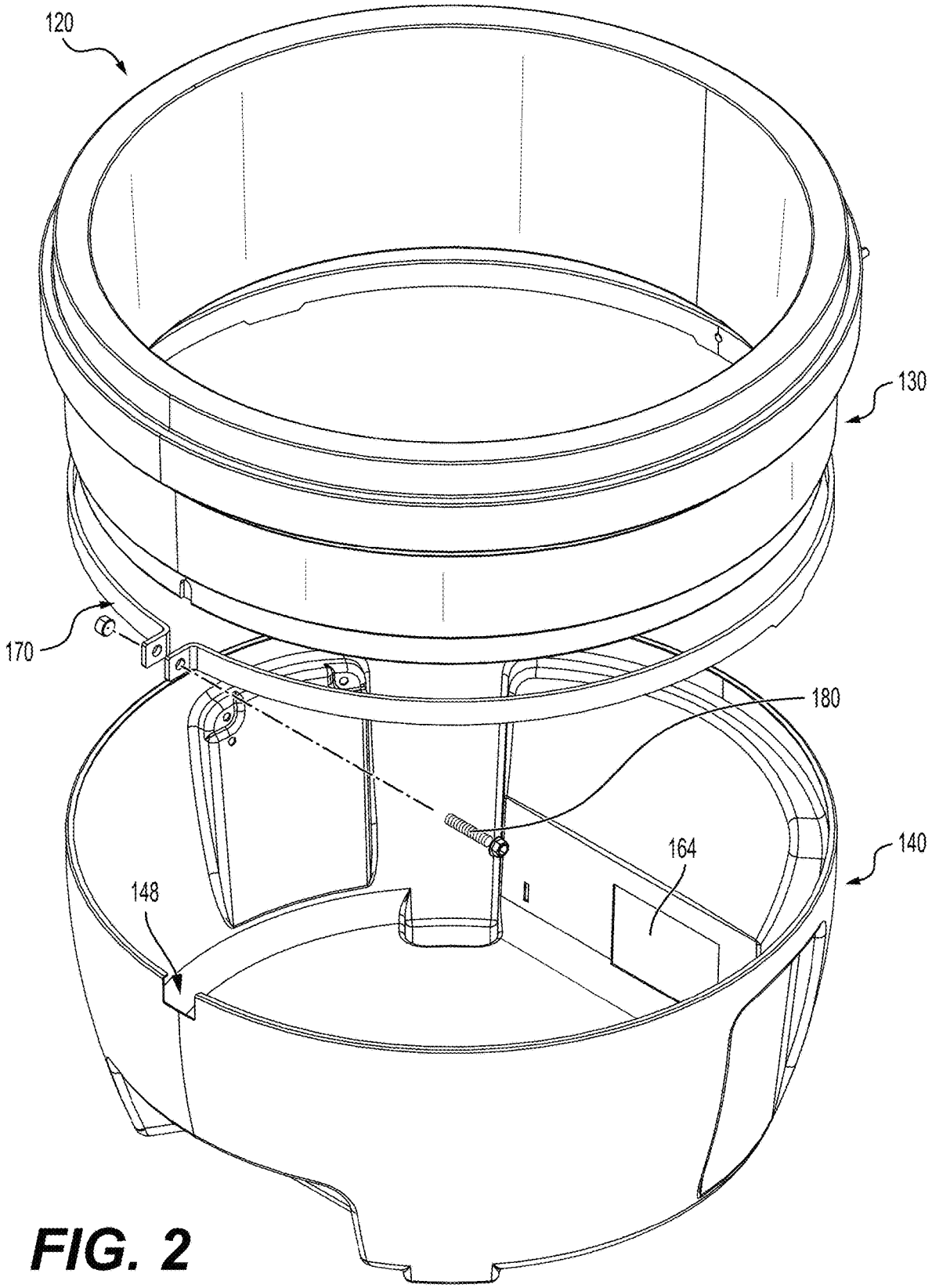
FIG. 2 is an exploded view of an exemplary base of a kamado-style grill that may be used in accordance with certain embodiments of the present invention.

FIG. 2 is an exploded view of a base 120 of the kamado-style grill 100, in accordance with an exemplary embodiment of the presently disclosed invention. In addition to ceramic portion 130 and metal portion 140, the base 120 may further comprise a tension element 170. The tension of tension element 170 with respect to ceramic portion 130 and metal portion 140 may be adjusted via a fastener 180 to join and secure the ceramic portion 130 to the metal portion 140 once assembled. Fastener 180 may comprise a nut-and-bolt type fastener as illustrated, for instance, in FIG. 2. While FIG. 2 illustrates a nut-and-bolt type fastener, it is understood that fastener may be any type of fastener now known or later discovered capable of expanding (e.g., loosening) and retracting (e.g., tightening) the tension element 170. The fastener 180 may be configured to fit within, and may stick out from, a designated area of the metal portion 140 so that the fastener 180 can be accessed by a user outside of the grill 100.

Figure 3:
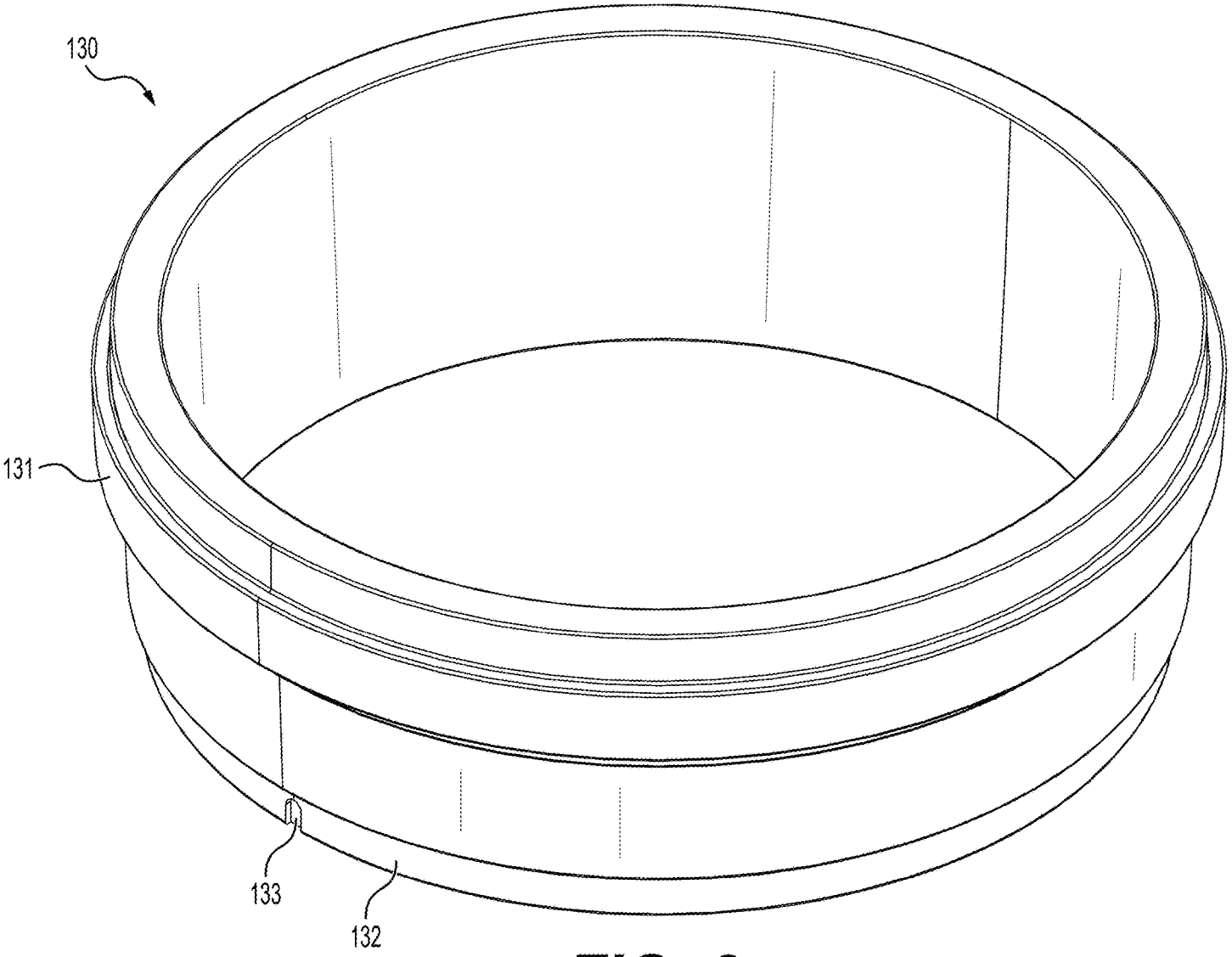
FIG. 3 is a perspective view of an exemplary ceramic portion of a base of a kamado-style grill that may be used in accordance with certain embodiments of the present invention.

As FIGS. 2 and 3 illustrate, the ceramic portion 130 may be ring-shaped and comprise a hollow main body 131 and a recessed lip 132 forming a bottom edge of the main body 131. Recessed lip 132 may be disposed inwardly from main body 131 and be sized to fit within metal portion 140 when the base 120 is assembled. In some embodiments, the recessed lip 132 may further comprise a cutout 133 to assist with positioning the tension element 170 around the recessed lip 132 when the base 120 is assembled.

Figure 4:
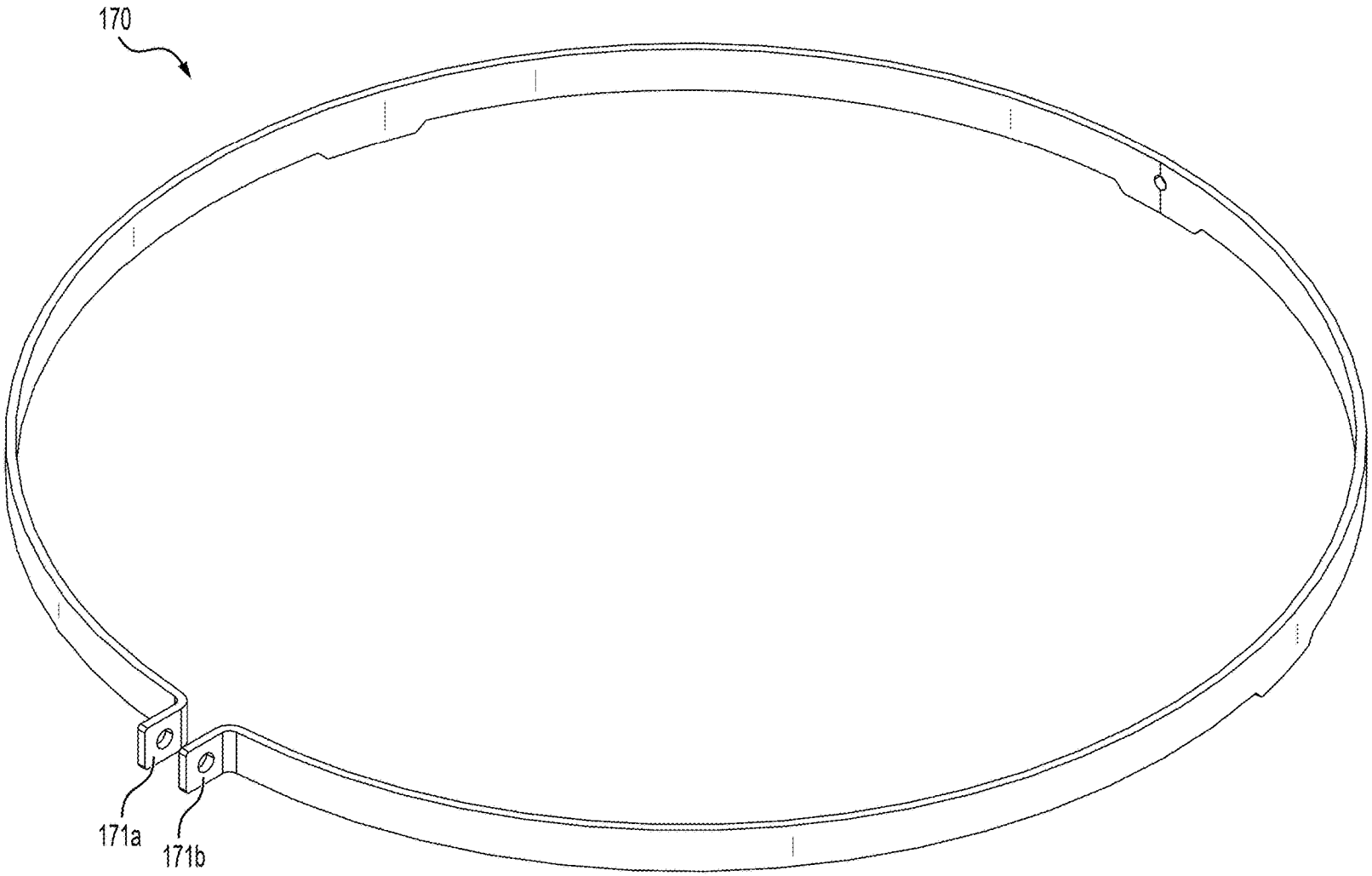
FIG. 4 is a perspective view of an exemplary tension element in the form of a ring-shaped tension band that may be used in accordance with certain embodiments of the present invention.

Base 120 may further comprise a tension element 170 which is sized and shaped to fit between metal portion 140 and top ceramic portion 130 when the base is assembled. FIG. 4 illustrates an exemplary tension element 170. In some embodiments, the tension element 170 may be ring-shaped and comprise a flexible material (e.g., metal such as steel). Tension element 170 may further comprise two tab elements 171*a*, 171*b*, wherein each tab element 171*a*, 171*b* comprises a hole for receiving a fastener, such as a nut and bolt (e.g., fastener 180 in FIG. 2).

Figure 5A:
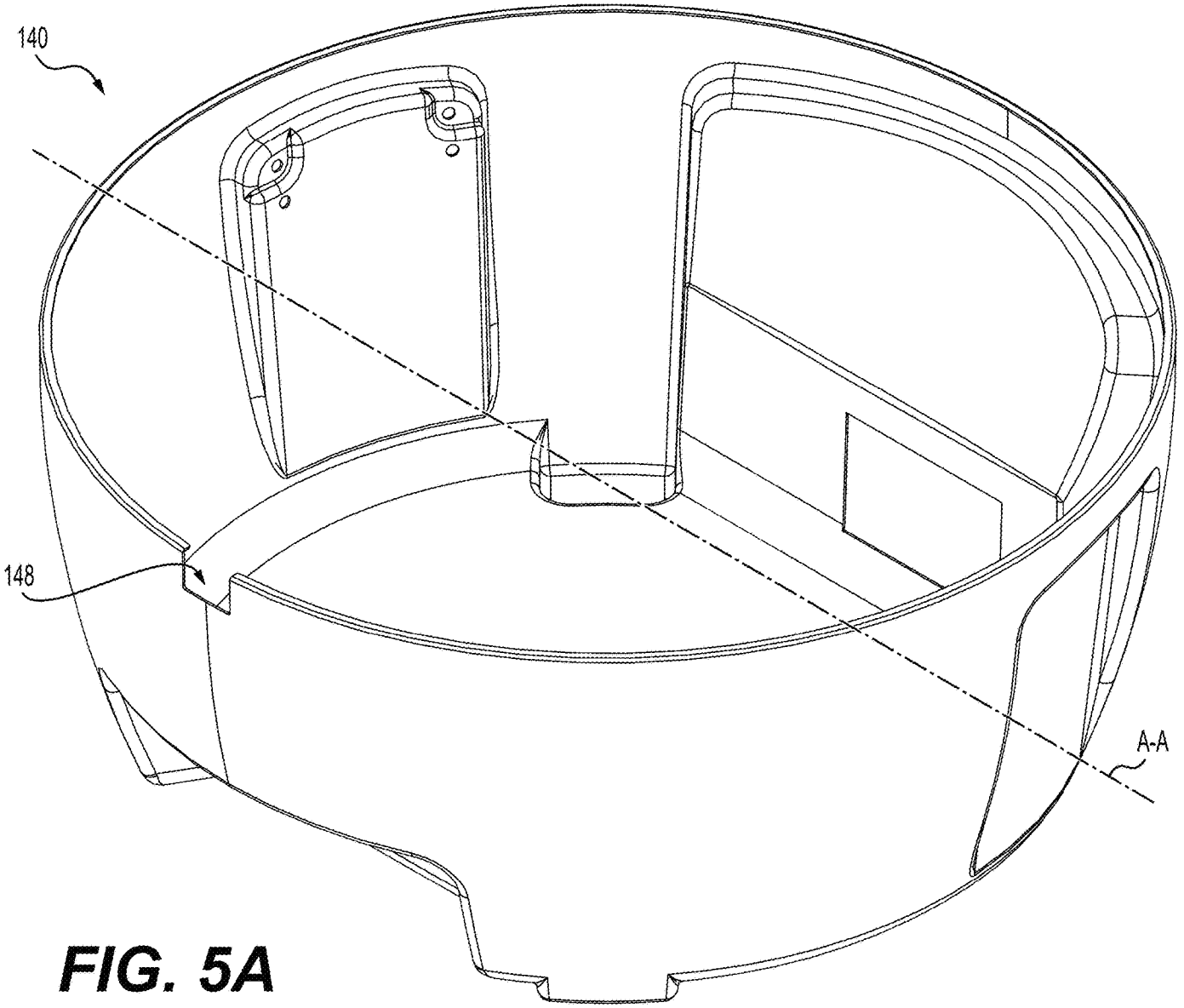
FIG. 5A is a perspective view of an exemplary metal portion of a base of the kamado-style grill and illustrating line A-A' through which the cross-section in FIG. 5B may be created, in accordance with certain embodiments of the present invention.
Figure 5B:
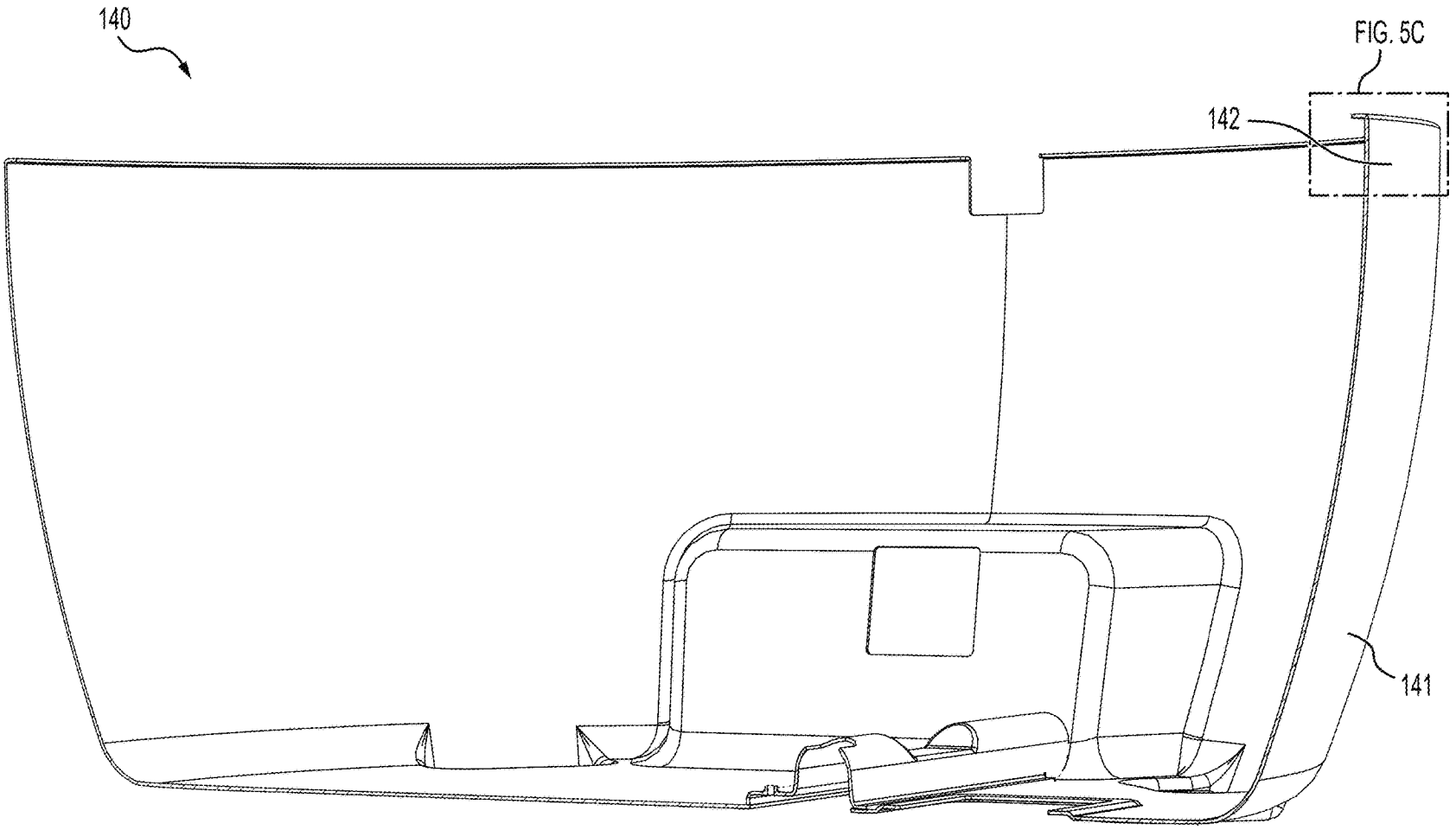
FIG. 5B is a cross-sectional view of the exemplary metal portion of the base created by passing a vertical plane through line A-A' in FIG. 5A, in accordance with certain embodiments of the present invention.
Figure 5C:
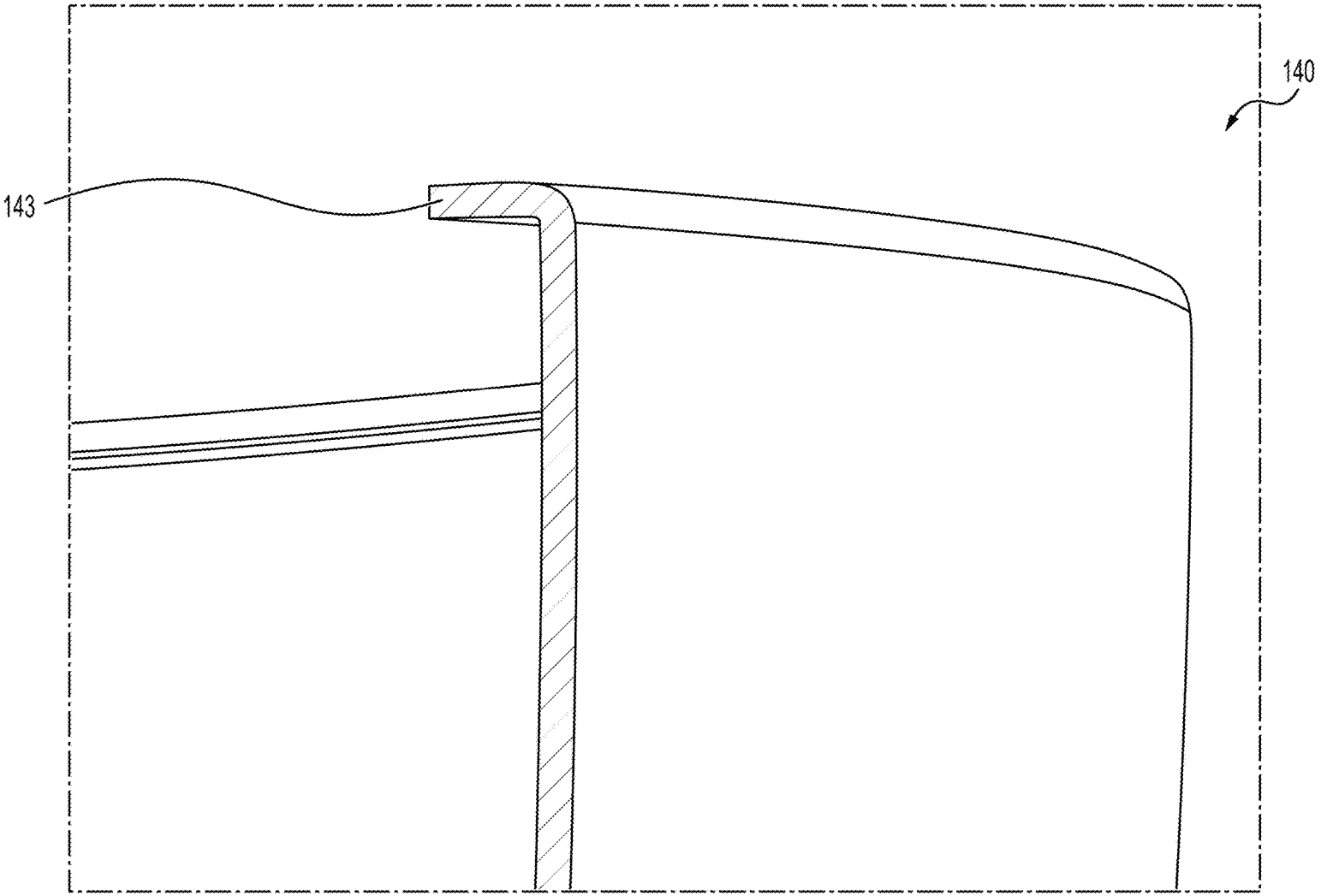
FIG. 5C is a close-up view of the upper lip or ledge of the exemplary metal portion of the base shown in FIG. 5B, in accordance with certain embodiments of the present invention.

FIGS. 5A-5C illustrate an exemplary metal portion 140 of base 120. Metal portion 140 can comprise a lower body 141 and an upper junction area 142 configured to join with the ceramic portion 130 as illustrated for instance in FIG. 6. Upper junction area 142 may generally comprise a top portion of the metal portion 140. Metal portion 140 may further comprise an upper lip or ledge 143 (e.g., a substantially horizontal ledge) as FIG. 5C shows. Upper ledge 143 may protrude inwardly from a top edge of the metal portion 140. The metal portion may also comprise a cut-out 148 for receiving tabs 171*a*, 171*b* (as illustrated, for instance, in FIG. 6) and holding them in place when base 120 is assembled. The tabs 171*a*, 171*b* may extend through the cut-out 148 so that they may be accessed by a user located outside of the grill 100.

Figure 6:
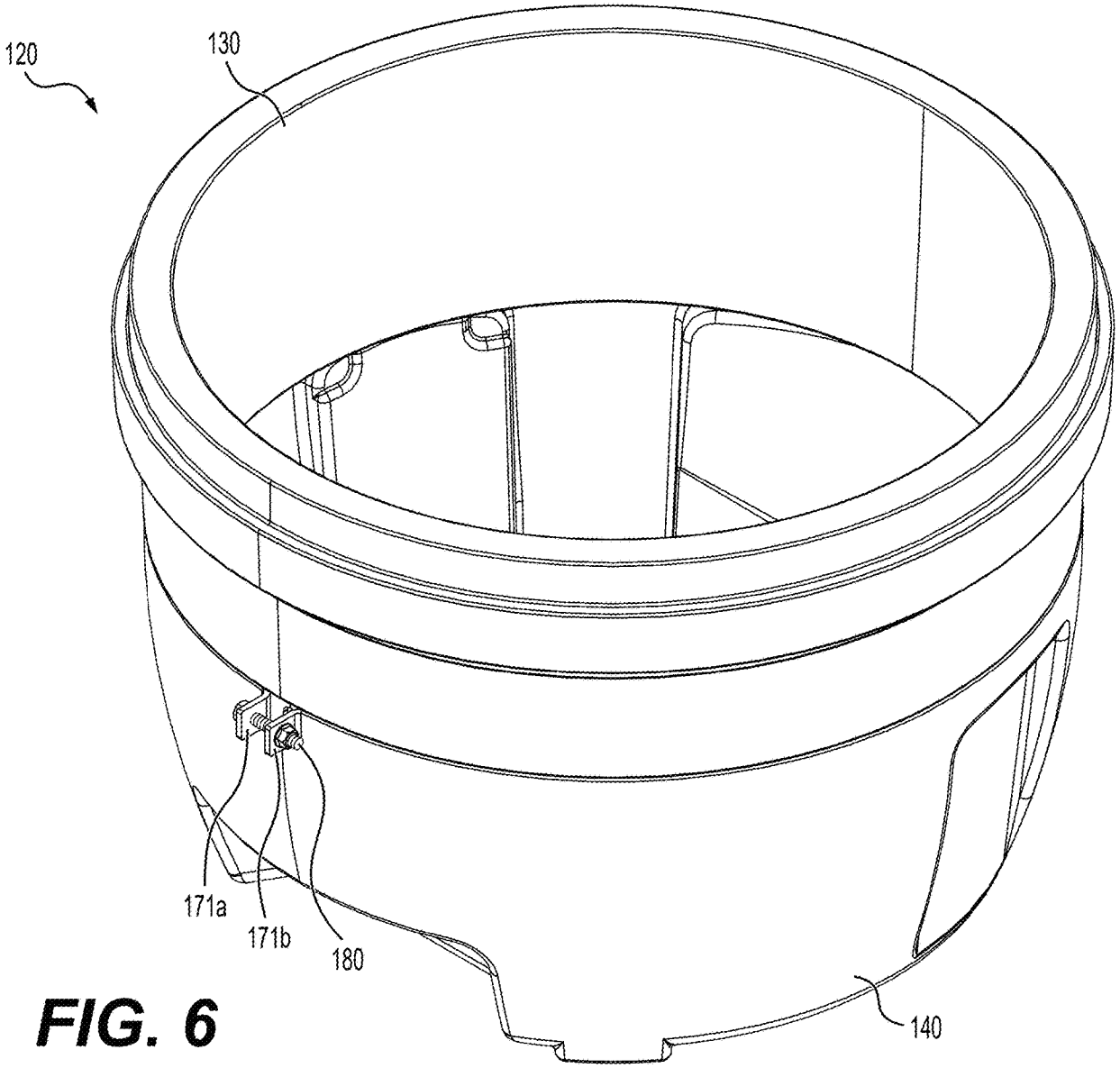
FIG. 6 is a perspective view of the exemplary metal portion, exemplary ceramic portion, and exemplary tension band assembled to form a base of the kamado-style grill and illustrating a line B-B' through which the cross-section view in FIG. 7A may be created, in accordance with certain embodiments of the present invention.
Figure 7A:
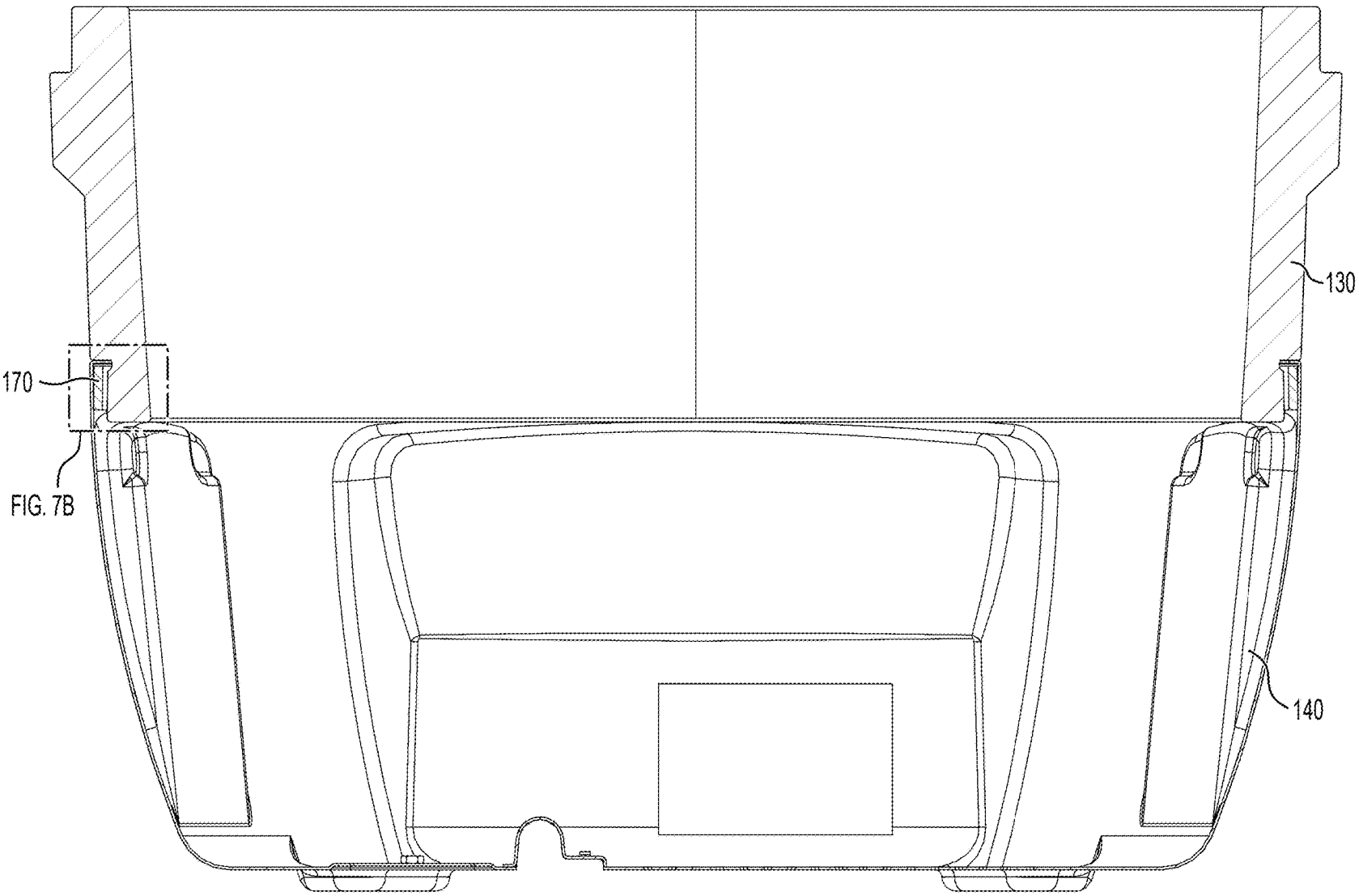
FIG. 7A is a cross section of the assembled base of FIG. 6 created by passing a vertical plane through the line B-B' in FIG. 6, in accordance with certain embodiments of the present invention.
Figure 7B:
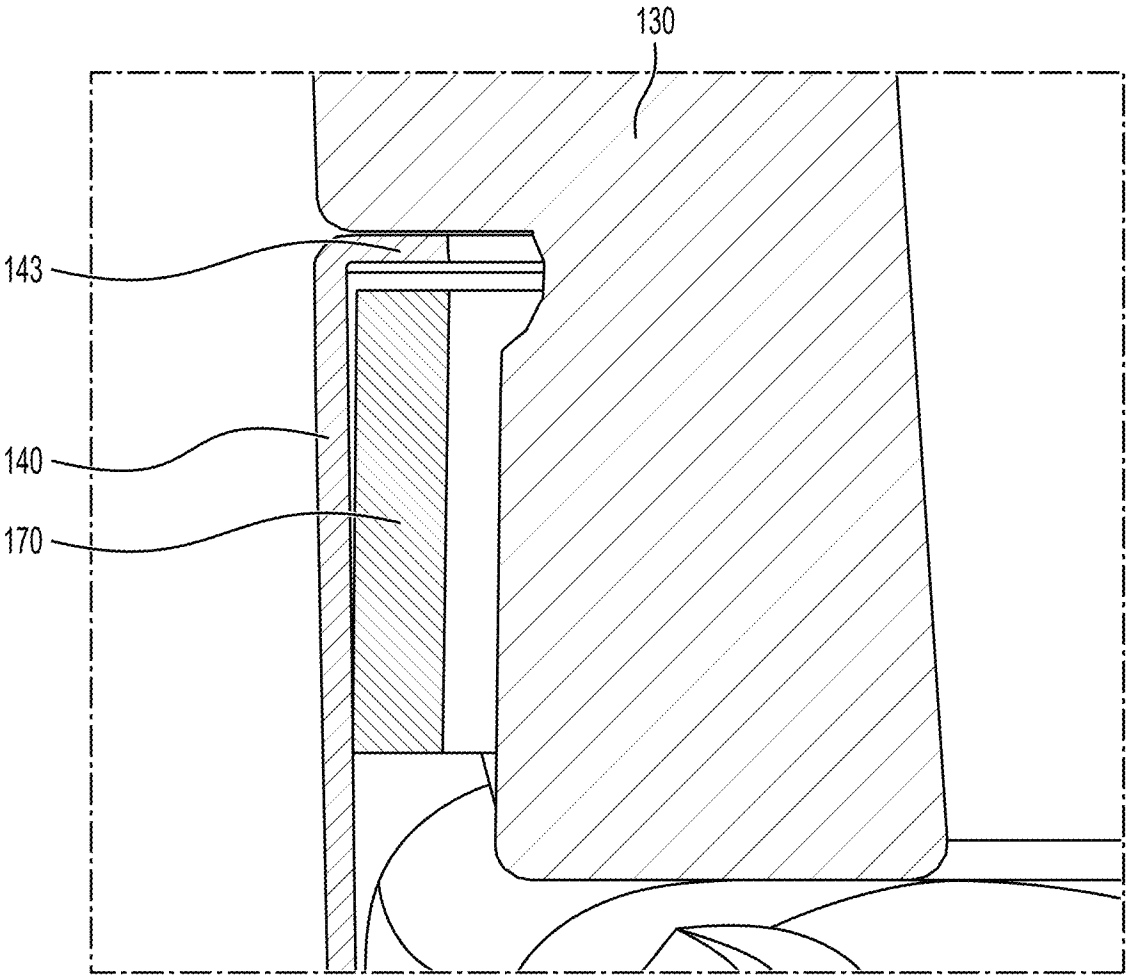
FIG. 7B is a close-up view of the junction between the exemplary metal portion, exemplary ceramic portion, and exemplary tension band of the assembled base shown in FIG. 7A, in accordance with certain embodiments of the present invention.

FIG. 6 illustrates the exemplary base 120 with the ceramic portion 130 inserted within the metal portion 140 when the base is assembled. When ceramic portion 130 is inserted within metal portion 140, the tabs 171*a* and 171*b* may be accessible by a user from the outside of the base via cut-out 148. As such, fastener 180 can be tightened or loosened in order to expand/retract the tension element 170. As FIGS. 7A and 7B illustrate, when the tension element 170 is adjusted, a friction fit may be formed between ceramic portion 130, tension element 170, and metal portion 140 to hold both ceramic and metal portions together. Additionally, upper ledge 143 is positioned above tension element 170 to prevent it from slipping out of place and to prevent a user from forcibly pulling the ceramic portion 130 out from the metal portion 140.

Those skilled in the art will appreciate that other modifications and alternatives may be implemented in accordance with the exemplary embodiments described herein. For instance, while the disclosed embodiments describe joining and securing ceramic and metal components, it is understood that the systems and methods described herein may be used in joining and securing other types of materials. Additionally, while the disclosed systems and methods are shown in the base of a kamado-style grill, it is understood that they may be used in other portions of the kamado-style grill or for connecting portions in other types of apparatuses more generally.

While this invention has been described with reference to certain disclosed embodiments, it is to be understood that variations and modifications can be affected within the spirit and scope of the invention as described herein and as described in the appended claims. Accordingly, this description is to be taken only by way of example and not to otherwise limit the scope of the exemplary disclosed embodiments herein. Therefore, it is the object of the appended claims to cover all such variations and modifications as come within the true spirit and scope of the embodiments disclosed herein.

We claim:

1. A kamado-style grill comprising:

a base comprising a first section and a second section, wherein:

the first section comprises a main body and a recessed region, and the second section comprises a ledge and a side wall, wherein the ledge protrudes inwardly from the side wall, and wherein the recessed region of the first section of the base is positioned inside the second section of the base; and a tension element positioned below the ledge and between the recessed region of the first section and the side wall of the second section, wherein the tension element is configured to expand or retract around the recessed region of the first section of the base to join the first and second sections of the base.

2. The kamado-style grill of claim 1, wherein the first section of the base comprises a first material and the second section of the base comprises a second material, and wherein the first material is different from the second material.

3. The kamado-style grill of claim 2, wherein the first material is a refractory material and the second material is a metal.

4. The kamado-style grill of claim 3, wherein the refractory material comprises a ceramic and the metal comprises cold rolled steel.

5. The kamado-style grill of claim 1, wherein the tension element is a ring-shaped band formed from a metal strip.

6. The kamado-style grill of claim 5, wherein the ring-shaped band comprises two unconnected ends, wherein each unconnected end of the ring-shaped band comprises a tab.

7. The kamado-style grill of claim 6, wherein each tab comprises a hole configured to receive a fastener.

8. The kamado-style grill of claim 7, wherein the tension element is configured to expand and retract by tightening or loosening the fastener.

9. The kamado-style grill of claim 6, wherein the second section of the base comprises a cut-out configured to receive the tabs of the tension element.

10. A method for assembling a base of a kamado-style grill, wherein the kamado-style grill comprises a base having a first section with a main body and a recessed region and a second section having a side wall and a ledge that protrudes inwardly from the side wall, the method comprising:

positioning a tension element around the recessed region of the first section, the tension element comprising a fastener for expanding and retracting the tension band;

placing the recessed region of the first section of the base into the second section; and tightening the fastener on the tension element to adjust the tension band around the recessed region and join the first and second sections of the base.

11. The method of claim 10, wherein the first section of the base comprises a first material and the second section of the base comprises a second material, and wherein the first material is different from the second material.

12. The method of claim 11, wherein the first material is a refractory material and the second material is a metal.

13. The method of claim 12, wherein the refractory material is a ceramic and the metal is cold rolled steel.

14. The method of claim 10, wherein the tension element is a ring-shaped band formed from a metal strip.

15. The method of claim 14, wherein the ring-shaped band comprises two unconnected ends, wherein each unconnected end of the ring-shaped band comprises a tab.

16. The method of claim 15, wherein each tab comprises a hole configured to receive a fastener.

17. The method of claim 16, wherein the tension element is configured to expand and retract by tightening or loosening the fastener.

18. The method of claim 16, wherein the second section of the base comprises a cut-out configured to receive the tabs of the tension element.

* * * * *